US006579390B2

(12) United States Patent
Tedford, Jr.

(10) Patent No.: US 6,579,390 B2
(45) Date of Patent: Jun. 17, 2003

(54) CONTAINER PATCH AND METHOD OF FORMATION

(75) Inventor: Richard A. Tedford, Jr., Loveland, OH (US)

(73) Assignee: International Paper, Tuxedo, NY (US)

( * ) Notice: Subject to any disclaimer, the term of this patent is extended or adjusted under 35 U.S.C. 154(b) by 0 days.

(21) Appl. No.: 09/851,253

(22) Filed: May 9, 2001

(65) Prior Publication Data

US 2002/0185526 A1 Dec. 12, 2002

(51) Int. Cl.[7] ..... B65D 43/14; B65B 7/28

(52) U.S. Cl. ..... 156/69; 53/485; 229/103.1; 229/125.15; 229/125.33; 493/102

(58) Field of Search ..... 229/103.1, 123.2, 229/125.15, 125.33; 222/541; 53/485, 487; 156/69; 493/102, 103; 220/265, 288, 359.2, 359.3

(56) References Cited

U.S. PATENT DOCUMENTS

| | | | | |
|---|---|---|---|---|
| 3,596,829 A | | 8/1971 | Gardner | |
| 3,770,185 A | | 11/1973 | Reeves | |
| 3,951,331 A | | 4/1976 | Smith et al. | |
| 4,072,233 A | | 2/1978 | Kramer et al. | |
| 4,092,817 A | | 6/1978 | Rist, III | |
| 4,223,789 A | * | 9/1980 | Reil | 229/125.15 |
| 4,244,474 A | | 1/1981 | Wise | |
| 4,295,904 A | | 10/1981 | Schmit | |
| 4,318,479 A | | 3/1982 | Lisiecki | |
| 4,356,955 A | | 11/1982 | Schmit | |
| 4,397,401 A | * | 8/1983 | Ueno et al. | 156/69 |
| 4,553,693 A | | 11/1985 | Terajima et al. | |
| 4,585,498 A | * | 4/1986 | Lagerstedt et al. | 493/103 |
| 4,762,514 A | | 8/1988 | Yoshida | |
| 4,795,513 A | | 1/1989 | Jensen, Jr. | |
| 4,817,816 A | | 4/1989 | Leseman et al. | |
| 4,819,839 A | * | 4/1989 | Carlsson et al. | 229/125.33 |
| 4,830,273 A | * | 5/1989 | Kalberer et al. | 229/125.15 |
| 4,858,766 A | | 8/1989 | Tsai | |
| 4,986,859 A | * | 1/1991 | Watanabe | 493/103 |
| 5,052,614 A | | 10/1991 | Xuan | |
| 5,069,372 A | * | 12/1991 | Kawajiri | 229/123.2 |
| 5,087,235 A | | 2/1992 | Lafleur | |
| 5,201,459 A | | 4/1993 | Bettle, Jr. et al. | |
| 5,325,983 A | * | 7/1994 | Imai et al. | 229/125.15 |
| 5,348,217 A | | 9/1994 | Bettle, Jr. et al. | |
| 5,425,583 A | | 6/1995 | Wild | |
| 5,653,383 A | * | 8/1997 | Adachi et al. | 229/125.15 |
| 5,722,561 A | | 3/1998 | Biondich et al. | |
| 5,782,404 A | | 7/1998 | Robichaud et al. | |
| 5,833,368 A | | 11/1998 | Kaufman | |
| 5,851,072 A | | 12/1998 | LaFleur | |
| 5,873,656 A | | 2/1999 | Arkins et al. | |
| 6,051,102 A | * | 4/2000 | Stahlecker | 53/485 |
| 6,090,029 A | | 7/2000 | LaFleur | |
| 6,116,782 A | | 9/2000 | Arkins et al. | |

FOREIGN PATENT DOCUMENTS

| | | | | |
|---|---|---|---|---|
| EP | 214791 A2 | * | 3/1987 | 229/123.2 |

OTHER PUBLICATIONS

The Wiley Encyclopedia of Packaging Technology, John Wiley & Sons, pp. 270 and 271 (1986).*

* cited by examiner

*Primary Examiner*—Gary E. Elkins
(74) *Attorney, Agent, or Firm*—Hoffman, Wasson & Gitler, P.C.

(57) ABSTRACT

A patch, method of applying a patch, and an applicator device for application of the patch to cover the opening of a hole in a gable-top carton panel. The patch is made from a frangible laminate material and is welded to the underside of the carton panel, corresponding to the side in contact with the beverage contained therein. The welder is located outside the container and the patch is applied to the carton after bottom seal formation.

2 Claims, 1 Drawing Sheet

CONTAINER PATCH AND METHOD OF FORMATION

BACKGROUND OF THE INVENTION

The invention relates to a gable-top or other beverage container with a post forming applied straw patch or cover. The patch or cover is a weldable, frangible barrier material for the gable straw opening. Also disclosed is an inventive process for producing the frangible material, as well as a unique application for applying the cover to the gable straw opening.

Previous methods for producing a straw opening have been based on applying webs or types of barrier material to webs of a package substrate. In limited cases where a local patch has been applied, the patch has been a two or more part system where removal of a top cover or other manipulation was required to expose and precondition the straw opening so that it could be pierced.

In addition, local patch applications in current practice require much higher penetration forces than extrusion over void manufacturing methods.

The gable-top strawhole has to be visible, provide an oxygen barrier, and be puncturable by a straw with comparable force to an aseptic juice package.

It is an objective of the present invention to provide a patch or cover for a strawhole opening in a gable-top container top that has a similar appearance to an opening in an aseptic container.

It is an objective of the present invention to provide a patch or cover for a strawhole opening in a gable-top container that provides an oxygen barrier and is puncturable by a straw with comparable force to an aseptic juice container.

SUMMARY OF THE INVENTION

A patch or cover for a strawhole for a gable-top container, or the like, including a piece of frangible barrier film applied to a carton after bottom formation. The frangible film is welded on the inside of the carton, with the welding energy being applied from the outside (ultrasonic or induction) and travels through the paper laminate to produce a thermoplastic seal. The patch is applied by a small application component which holds the patch for welding and can be used for small cartons.

DETAILED DESCRIPTION OF THE INVENTION

Figure 1:
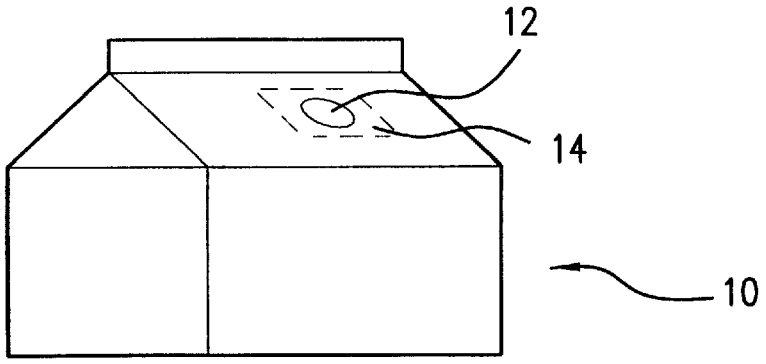
FIG. 1 is a perspective view of a gable-top container having a patch embodying the present invention.
Figure 2:
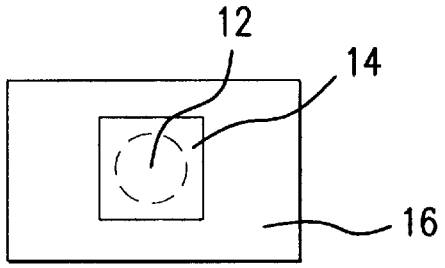
FIG. 2 is a view of an inside of a top panel of a gable top carton having a patch welded thereon.
Figure 3:
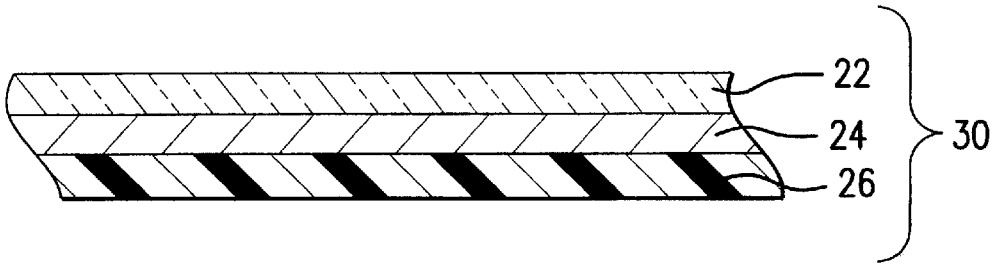
FIG. 3 is a cross-section of the barrier laminate embodying the patch of the invention.

A finished package, such as a gable top container 10, is provided with a die cut strawhole 12 covered by an internal patch 14 circumadjacent to the strawhole on the product contact side 16 of the container 10.

The patch 14 is composed of a barrier film 26, an aluminum foil stiffener layer 24, and a thermoplastic seal layer 22 which is compatible with low density polyethylene seals. The layers 30 the patch material are extrusion laminated together to provide resistance to delamination when in contact with beverages. The patch material is puncturable with a 6 mm–2.54 cm diameter drinking straw made of 1 mil of polyolefin with a puncture force of less than 4 pounds.

The patch applicator means includes a tape metering device, a cut to length mechanism, a vacuum equipped mandrel for insertion of the patch into the carton, and a welding energy source located outside of the package. By applying the patch after the carton bottom is formed, the possibility of damage through contact with a filling machine is minimized.

The following is a representative barrier structure set forth in tabular form from inside (product contact) to seal layer 22.

| Layer | Material | Thickness |
|---|---|---|
| Barrier film | LDPE/EVOH/LDPE | .001 inches |
| Tie layer | Nucrel ® | 4 lbs/3,000 sf |
| Foil layer | Aluminum Foil | — |
| Tie layer | Nucrel ® | 4 lbs/3,000 sf |
| Sear layer | EVA | 4 lbs/3,000 sf |

LDPE = low density polyethylene
EVOH = ethylene vinyl alcohol copolymer
EVA = ethylene vinyl acetate The welded or sealed area or seal layer can cover the complete patch or only a thin perimeter of the patch material in contact with the inside layer of the carton.

Numerous patch material structures can be used including those which are pigmented in a variety of colors or metallic. The shape of the patch can vary and may include round, square, triangular, and the like as desired. Likewise, the shape of the opening in the gable top can vary.

A "twist-cap" can be applied over the patch to allow for opening and pouring of the beverage instead of a straw.

The patch can be applied while the carton is in the web or blank form.

The patch and/or the carton wall can have different barrier properties. (The carton wall need not have an aluminum foil barrier, but the externally visible patch can.)

Through use of an ultrasonic filament welder, it is possible to apply small patches of thin material to the area of interest. These patches are comparable to aseptic brick openings in appearance and function. However, no additional components need to be applied to the patch area to allow functioning of a straw. Because the welding energy is transmitted through the carton instead of through the patch, it is possible to use more dedicated membranes for the patch than in a typical two piece application which applies heat through the patch.

The embodiments described above are exemplary of the subject matter of the invention. The invention can be interpreted by a reasonable person skilled in the art to include modifications or changes and the invention is only limited by the scope of the appended claims.

What is claimed is:

1. A method of applying a patch to an opening of a gable-top panel carton comprising the steps of:

welding the patch, which comprises a laminate frangible material layer welded to an underside of the gable-top carton panel, the laminate frangible material layer comprising a barrier layer, a foil layer and a thermoplastic seal layer, to an underside of the gable-top carton panel by welding with an energy source contained on an outside of the carton.

2. The method of applying the patch to an opening of a gable-top carton as claimed in claim 1, wherein the patch is welded to the underside of the gable top carton panel after a carton bottom panel has been formed.

* * * * *